US009947495B2

(12) United States Patent
Vallier et al.

(10) Patent No.: US 9,947,495 B2
(45) Date of Patent: Apr. 17, 2018

(54) ARC EXTINGUISHING CHAMBER FOR ELECTRICAL CIRCUIT BREAKER AND CIRCUIT BREAKER COMPRISING SUCH A CHAMBER

(71) Applicant: Schneider Electric Industries SAS, Rueil Malmaison (FR)

(72) Inventors: Herve Vallier, Monestier de Clermont (FR); Loic Rondot, Grenoble (FR); Jean-Claude Ramirez, Saint Martin D'Uriage (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 14/951,715

(22) Filed: Nov. 25, 2015

(65) Prior Publication Data

US 2016/0181034 A1 Jun. 23, 2016

(30) Foreign Application Priority Data

Dec. 19, 2014 (FR) ..... 14 62947

(51) Int. Cl.
*H01H 33/08* (2006.01)
*H01H 33/20* (2006.01)
(Continued)

(52) U.S. Cl.
CPC ..... *H01H 33/08* (2013.01); *H01H 9/36* (2013.01); *H01H 33/20* (2013.01); *H01H 73/18* (2013.01); *H01H 2009/365* (2013.01)

(58) Field of Classification Search
CPC ..... H01H 33/08; H01H 33/20; H01H 33/10; H01H 9/34; H01H 9/36; H01H 2009/365;
(Continued)

(56) References Cited

U.S. PATENT DOCUMENTS 2,744,983 A * 5/1956 Taylor ..... H01H 9/34 218/151
5,504,292 A 4/1996 Bennett et al.

FOREIGN PATENT DOCUMENTS

CN 101546681 9/2009
FR 2 814 851 A1 4/2002
(Continued)

OTHER PUBLICATIONS

French Preliminary Search Report issued Jun. 26, 2015 in French Application 14 62947, filed on Dec. 19, 2014 ( with English translation of Categories of Cited Documents).

*Primary Examiner* — Renee S Luebke
*Assistant Examiner* — William Bolton
(74) *Attorney, Agent, or Firm* — Oblon, McClelland, Maier & Neustadt, L.L.P.

(57) ABSTRACT

The present disclosure relates to an arc extinguishing chamber of an electrical circuit breaker, including an arc-forming chamber enclosing a fixed contact and a moving contact, which, at the time of their separation, form an arc between them, said forming chamber communicating with the input of an arc-quenching chamber comprising a stack of separators extending parallel to one another, and including a magnetic release situated on the side of the fixed and moving contacts and a switching horn situated on the opposite side, where the form of the separators varies progressively from one separator to the next, or by groups of identical separators from one group to another, or a mixture of both, in such a way that this form changes from the V having the largest opening surface area to the V having the smallest opening surface area, in the direction from the magnetic release to the switching horn.

1 Claim, 1 Drawing Sheet

(51) Int. Cl.
*H01H 9/36* (2006.01)
*H01H 73/18* (2006.01)

(58) Field of Classification Search
CPC ..... H01H 73/18; H01H 9/345; H01H 71/00; H01H 33/60
USPC ..... 218/148, 149, 150, 151, 155, 156
See application file for complete search history.

(56) References Cited

FOREIGN PATENT DOCUMENTS

| | | | |
|---|---|---|---|
| JP | 51-153452 | U | 12/1976 |
| WO | WO 2010/043487 | A1 | 4/2010 |

* cited by examiner

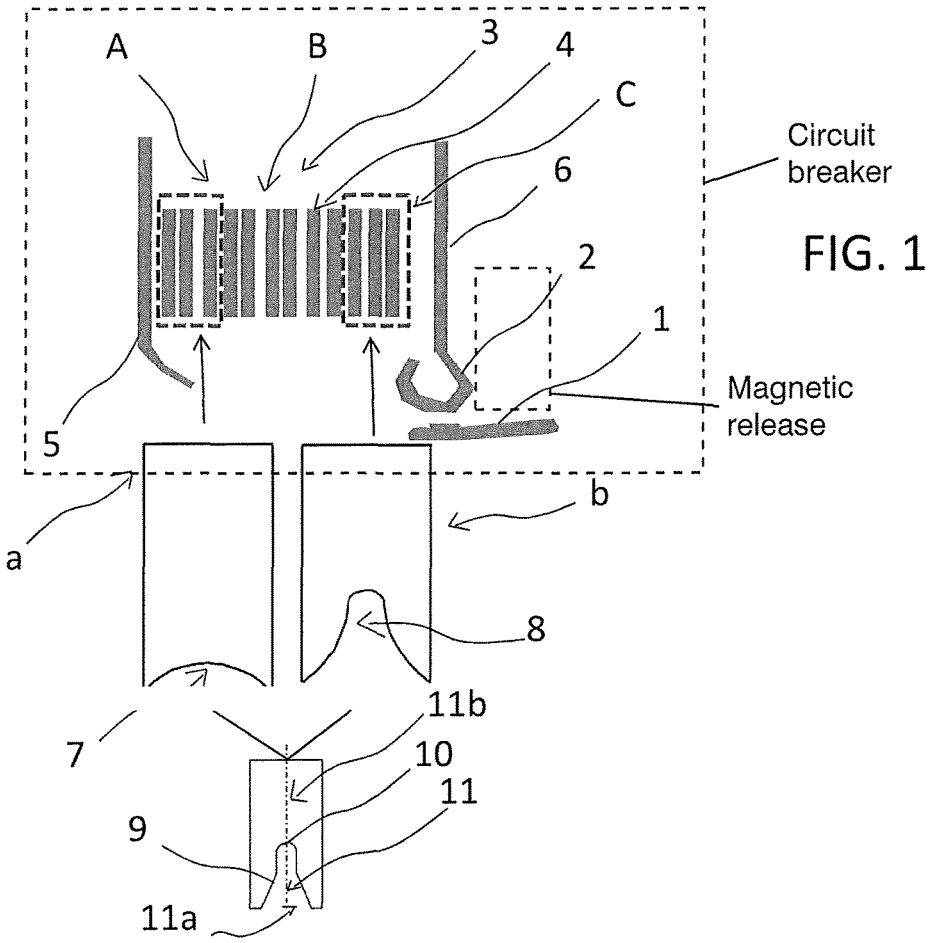
FIG. 1
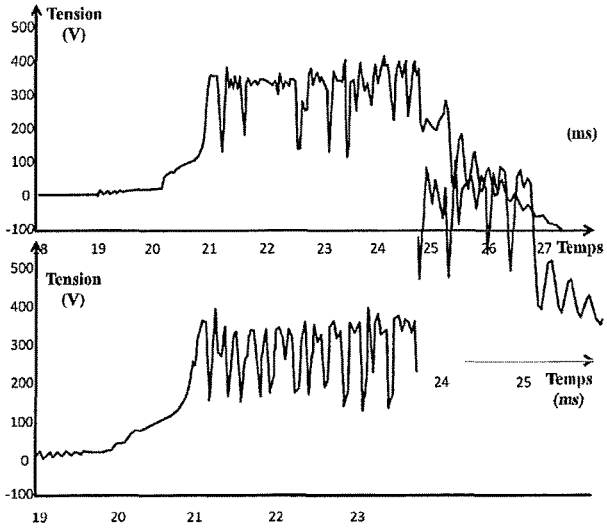
FIG. 2
FIG. 3

ARC EXTINGUISHING CHAMBER FOR ELECTRICAL CIRCUIT BREAKER AND CIRCUIT BREAKER COMPRISING SUCH A CHAMBER

TECHNICAL FIELD

The invention relates to an arc extinguishing chamber of an electrical circuit breaker, comprising an arc-forming chamber enclosing a fixed contact and a moving contact, which, at the time of their separation, form an arc between them, said forming chamber communicating with the input of a second so-called arc-quenching chamber comprising a stack of separators extending substantially parallel to one another, this moving contact extending substantially at right angles to the plane of the separators, so as to pull an arc between the contacts upon their separation, the initial direction of which is substantially parallel to said separators, these separators having, on the side of the moving contact, an opening intended to facilitate the insertion of the arc, said circuit breaker comprising a magnetic release situated on the side of the fixed and moving contacts and a switching horn situated on the opposite side.

PRIOR ART

In known circuit breakers, in particular miniature circuit breakers, after switching of the arc, the latter moves in the direction of the arc-quenching chamber.

This arc-quenching chamber comprises separators (or splitters) formed by stacked plates which extend substantially parallel to the plane of the base of the circuit breaker, via which base the circuit breaker is intended to be mounted on a mounting support.

This arc-quenching chamber helps limit the short-circuiting current by means of quenching of the arc inside said chamber.

Between the instant the arc is inserted inside the chamber and the instant it is quenched, the arc voltage must increase rapidly in order to limit the current and consequently produce a thermal stress which is as low as possible.

Generally, the arc is not inserted in a uniform manner inside the separators. In order to improve said insertion, it is known to provide the separators with slots, which are generally in the form of a V which is more or less open.

This non-uniform entry results in an arc voltage which is the cause of numerous phenomena referred to as "disruptive discharge" consisting essentially in a reduction in the arc voltage and therefore the limiting effect of the circuit breaker.

SUMMARY OF THE INVENTION

The present invention solves these problems and proposes an extinguishing chamber for a circuit breaker, wherein insertion of the arc inside the arc-quenching chamber is rendered more uniform, this reducing significantly the thermal discharge effects generated upon quenching and hence limiting considerably the risks of the housing melting, as well as a circuit breaker comprising such a chamber.

To this end, the present invention relates to an extinguishing chamber of the aforementioned kind, this chamber being characterized in that the form of the separators varies progressively from one separator to the next, or by groups of identical separators from one group to another, or a mixture of both, in such a way that this form changes from the V having the largest opening surface area to the V having the smallest opening surface area, in the direction from the magnetic release to the switching horn.

Owing to these characteristic features, improved insertion of the arc in the splitters is obtained, this reducing the discharge effects. The form of the extinguishing chamber also allows an increase in the mass of the splitters which are greatly stressed during quenching. This increase in mass allows a reduction in the post-quenching effects of melting of the product, due to the thermal radiation of the splitters on the plastic housing of the circuit breakers following quenching.

According to another particular characteristic feature, the form of the separators varies between a form of a V formed in a curvilinear manner over its entire length and a form of a circle arc, in the direction from the magnetic release to the switching horn.

According to another characteristic feature, these separators are distributed in three different groups, i.e. a first group, a second group and a third group, the separators which belong to a same group having substantially the same form, whereby in the first group situated on the side of the switching horn of the circuit breaker, the opening of the separators has a semi-circular form and whereby, in the third group situated on the opposite side, namely the side of the fixed contact and moving contact, the opening of the separators has a general form of a V formed in a curvilinear manner over the entire length of the opening, while in the second group situated in the middle of the other two, the opening of the separators has a first part in the form of a V portion extended by a slot, in such a way that the cross-section of the first part of the opening decreases from the end of the opening, situated towards the outside of the separator, in the direction of its other end, situated towards the inside of the said separator.

The present invention also relates to a low-voltage electrical circuit breaker comprising an extinguishing chamber having the characteristic features mentioned above considered singly or in combination.

BRIEF DESCRIPTION OF THE DRAWINGS

However further advantages and characteristic features of the invention will become clear from the detailed description which follows and which refers to the attached drawings provided solely by way of example in which:

FIG. 1 shows a cross-sectional view of the extinguishing chamber along a plane perpendicular to the plane of the different separators, the three different forms of separators according to the invention also being shown in a planar view;

FIG. 2 is a graph illustrating the arc voltage (in volts) as a function of the time (ms) during quenching according to the prior art; and FIG. 3 is a graph illustrating the arc voltage (in volts) as a function of the time (ms) during quenching according to the invention.

DETAILED DESCRIPTION OF AN EMBODIMENT OF THE INVENTION

The circuit breakers allow the interruption of an electric current to be performed by means of separation of the contacts so as to protect objects and persons from the effects of the short-circuiting currents.

In a manner known per se, these apparatus comprise an insulating housing provided on its front side with an operating lever and on its two narrow side faces with connection terminals. The housing has internally a moving contact 1 and a fixed contact 2. This moving contact 1 is actuated by an actuating mechanism (not shown) connecting the aforementioned lever to the moving contact in order to close the contacts.

This housing also contains a thermal release and an electromagnetic release (both not shown) which are able to cause, in the event of overcharging or a short-circuit, automatic opening of the contacts. The interior of the housing encloses an extinguishing chamber consisting of a first chamber, or arc-forming chamber, communicating with the input of a second chamber 3, or arc-quenching chamber, the latter comprising separators 4 formed by a stack of plates (or sheets) which extend parallel to the base of the housing.

This moving contact 1 extends substantially perpendicularly to the plane of the plates considered separately, so as to pull an arc between the contacts when they are separated, the initial direction being substantially parallel to the plates. This extinguishing chamber is bounded laterally by arc horns 5,6 connected respectively electrically to the two aforementioned terminals, these two horns being arranged so as to capture the arc pulled between the contacts when they are separated.

According to the invention, this arc-quenching chamber comprises three groups of separators A,B,C, each group comprising separators identical to each other, but the form of these separators being different from one group to another. This modification in the form of the separators from one group to another concerns more particularly the form of the V.

Thus, on the side of the apparatus where the switching horn 5 is situated, the V's of the separators will be less open, in the sense that the opening 7 formed by the V's will have a smaller surface area, this being able to be increased until a semi-circular form such as that shown in FIG. 1 is obtained. On the side b of the apparatus where the magnetic release and the fixed contact 1 and moving contact 2 are situated, the opening 8 in the general form of a V in the separators of the third group C will have a curvilinear form, without discontinuity, while the V in the separators of the second group B situated between the two first groups A,C will retain a conventional V form, comprising a V portion 9 on the side of the opening of the separators extended by a slot 10 having a constant width over its whole length.

Thus, the cross-section of the first part 9 of the opening 11 decreases from the end 11 a of the opening 11, situated towards the outside of the separator, in the direction of its other end 11 b, situated towards the inside of said separator.

As shown in FIG. 3, the invention also allows the arc voltage to be increased considerably during quenching, this resulting in a considerable improvement in the current limitation, and hence, a significant reduction in the thermal stresses generated during quenching, resulting in the risk of melting of the housing being reduced significantly.

Thus the form of the splitters inside the chamber is modified so as to accelerate insertion of the arc on the magnetic side and slow down insertion of the arc on the switching rail side, and thus cause the arc to return perpendicularly inside the extinguishing chamber. In order to achieve this, the form of the V is very open on the magnetic side and very closed on the switching rail side. Since the mass of the extinguishing chamber must be protected from post-quenching problems (melting of plastic due to radiation of the chambers), the form of the splitters must change progressively.

The invention is applicable advantageously to all circuit breakers, whatever their pitch.

This modification proposed by the invention may be incorporated perfectly within the overall volume of the product and moreover does not require for installation thereof any additional component, apart from the need to provide three cutting dies for the separators.

Of course, the invention is not limited to the embodiment described and illustrated here which has been provided only by way of example.

On the contrary, the invention comprises all the technical equivalents of the means described as well as combinations thereof, provided that they are realized in keeping with the spirit of the invention.

The invention claimed is:

1. An electric circuit breaker, comprising an arc-forming chamber enclosing a fixed contact and a moving contact, which, at a time of separation, form an arc therebetween;

an arc-quenching chamber comprising a stack of separators extending parallel to one another;

a magnetic release situated on a side of the fixed contact and the moving contact; and a switching horn situated on an opposite side of the fixed contact and the moving contact, wherein said arc-forming chamber communicates with an input of the arc-quenching chamber comprising the stack of separators extending parallel to one another, wherein the moving contact extends substantially at right angles to a plane of the stack of separators, to pull an arc between the fixed contact and the moving contact upon separation, an initial direction of which is substantially parallel to the stack of separators, wherein the stack of separators have, on a side of the moving contact, a first opening facilitating the insertion of the arc, wherein a form of the stack of separators varies progressively from one separator to a next, or by groups of identical separators from one group to another, or a mixture of both, in such a way that the form of the stack of separators changes from a first V having a largest opening surface area to a second V having a smallest opening surface area, in a direction from the magnetic release to the switching horn, wherein the stack of separators are distributed in three different groups including a first group A, a second group B and a third group C, wherein the separators belonging to a same group having substantially a same form, wherein in the first group A, situated on a first side of the switching horn, a second opening of the stack of separators has a semi-circular form, wherein in the third group C, situated on an opposite side from the first side of the switching horn, the first opening of the stack of separators has a general form of a V formed in a curvilinear manner over an entire length of the first opening, wherein in the second group B, situated in a middle between the first group A and the third group C, a third opening of the stack of separators has a first part in a form of a V portion extended by a slot, in such a way that a cross-section of the first part of the third opening decreases from a first end of the third opening, situated towards an outside of the stack of separators, in a direction of a second end of the third opening, situated towards an inside of the stack of separators, wherein the first V having the largest opening surface area and the second V having the smallest opening surface area of the stack of separators have different opening surface areas, and wherein the stack of separators having the first V with the largest opening surface area is located closest to the magnetic release.

* * * * *